US007460805B2

(12) United States Patent
Adiletta

(10) Patent No.: US 7,460,805 B2
(45) Date of Patent: Dec. 2, 2008

(54) SYSTEM FOR INITIATING IMAGE-QUALITY TESTS IN A DIGITAL PRINTER

(75) Inventor: Mark A Adiletta, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 364 days.

(21) Appl. No.: 11/507,839

(22) Filed: Aug. 22, 2006

(65) Prior Publication Data

US 2008/0050133 A1 Feb. 28, 2008

(51) Int. Cl.
*G03G 15/00* (2006.01)

(52) U.S. Cl. ..... 399/49; 399/72

(58) Field of Classification Search ..... 399/15, 399/49, 72, 82

See application file for complete search history.

(56) References Cited

U.S. PATENT DOCUMENTS 5,148,268 A 9/1992 Tandon et al.
5,488,458 A 1/1996 Benedict et al.
6,048,117 A 4/2000 Banton
6,324,353 B1 11/2001 Laussermaier et al.
6,639,669 B2 10/2003 Hubble, III et al.
6,684,035 B2 1/2004 Furno et al.
6,728,000 B1 * 4/2004 Lapstun et al. ..... 399/82
6,883,892 B2 4/2005 Sievert et al.
6,972,867 B1 12/2005 Venable et al.
2007/0059006 A1 * 3/2007 Harigai et al. ..... 399/49

* cited by examiner

*Primary Examiner*—Susan S Lee
(74) *Attorney, Agent, or Firm*—R. Hutter

(57) ABSTRACT

A method of operating a digital printer comprises printing a machine-readable code and at least one test patch on at least one sheet. The photosensor detects the machine readable code on the moving sheet, and, in response to the detecting, initiates the photosensor reading the test patch on the moving sheet. The test patches can be distributed over many sheets, depending on the nature of the desired test routine and the type of sheet that has recently been output by the printer.

9 Claims, 2 Drawing Sheets

SYSTEM FOR INITIATING IMAGE-QUALITY TESTS IN A DIGITAL PRINTER

INCORPORATION BY REFERENCE

The following US Patent is hereby incorporated by reference in its entirety for the teachings therein: U.S. Pat. No. 6,639,669.

TECHNICAL FIELD

The present disclosure relates to digital printing apparatus, such as using xerographic or ink-jet technology, and carrying out image-quality tests therein.

BACKGROUND

In color printing using digital printers, it is common to use test patches for color calibration. The calibration process involves sending an image with pre-specified device signals (i.e., a "test patch") to the printer, and making spectrophotometric measurements of the test patches with the use of a spectrophotometric scanner. The device and spectrophotometric signals together are used to build or update the calibration tables or other controls associated with the printer.

U.S. Pat. Nos. 6,048,117 and 6,972,867 relate to the problem of calibrating each of a large population of digital printers, using a single input scanner, as would be used, for example, with a color digital copier. The systems described in these patents use bar codes, or other kinds of machine-readable code, on the sheets on which test patches are printed, in order to identify, among other things, the printer that was the source of each test sheet. U.S. Pat. No. 6,883,892 makes a similar teaching.

In a high-speed, production context, it is known to provide detectors and image sensors immediately downstream of a printing apparatus for various purposes, as shown in U.S. Pat. Nos. 5,488,458; 6,324,353; 6,684,035; and 6,987,025.

U.S. Pat. No. 6,639,669 discloses the use of machine-readable "triggers" on sheets bearing images to be tested.

U.S. Pat. No. 5,148,268 gives a description of a photosensitive chip useful as an image sensor.

SUMMARY

According to one aspect, there is provided a method of operating a digital printer. A control system decides whether to print a machine readable code on a first sheet and at least one test patch on a second sheet, or to print the machine readable code and the at least one test patch on a one sheet. The sheet having the machine-readable code moves at a substantially constant velocity past the photosensor following printing. In response to the photosensor detecting the machine-readable code, the photosensor reads the test patch.

DETAILED DESCRIPTION

Figure 1:
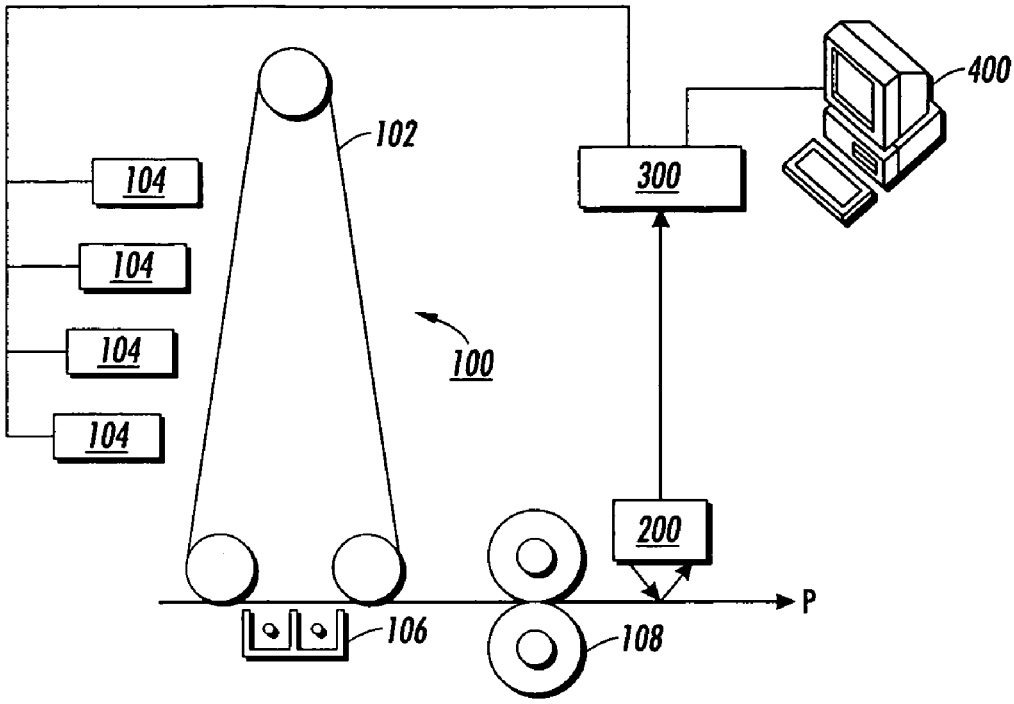
FIG. 1 is a simplified elevational view of a xerographic printer with a photosensor associated therewith.

FIG. 1 is a simplified elevational view of a printing apparatus; in this case a production-speed xerographic printer. The print engine 100 is of a type generally familiar in the art: a photoreceptor 102 rotates past imaging stations 104, one imaging station for each CMYK primary color, and each including (not shown) a charge device, laser, and development unit. Each imaging station, controlled by digital data supplied thereto, places toner according to a color separation of a desired image on the photoreceptor 102, and the total color image is then transferred to a print sheet at transfer station 106. The print sheet then moves in a process direction P through a fusing station 108, and continues, at a constant velocity, past what can be called a "photosensor" 200. Photosensor 200, which may include an associated light source, is positioned to read at least a strip of each sheet substantially immediately following fusing, fusing being considered in this embodiment the end of the printing process.

Figure 2:
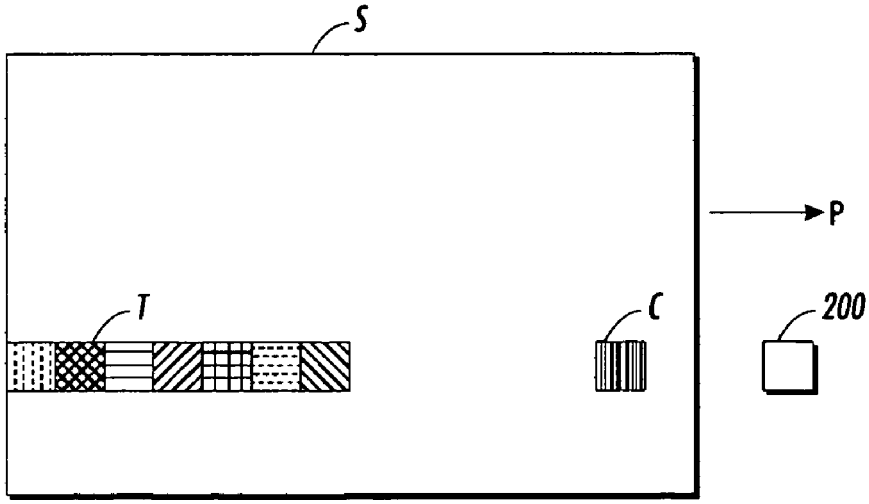
FIG. 2 is a plan view of a single sheet as would emerge from the printer and move past the photosensor as in FIG. 1.

FIG. 2 is a plan view of a single sheet S as would emerge from the fuser 108 and move past the photosensor 200 as in FIG. 1. As shown in the Figure, the sheet S is approaching the photosensor 200 along process direction P. The photosensor 200, in this embodiment, is of a width (perpendicular to P) of about 1 cm-3 cm, and is disposed to read a strip of comparable width on sheets S moving therepast.

The overall function of the disclosed system is that, when it is desired to perform a calibration, or other test routine involving one or more test patches, on a print engine 100, the print engine is simply caused to print, on one or more sheets, a machine-readable "trigger" code, plus one or more test patches. Following printing, the sheet moves at a substantially constant velocity past the photosensor 200. When the photosensor 200 reads and recognizes the trigger code, an associated control system, generally indicated as 300, is programmed to expect inputs from one or more test patches. The reflected light from the test patches is received by the photosensor 200 for purposes of calibration or other control. In one embodiment, the velocity of a sheet does not appreciably change between receiving an image, such as at transfer station 106 or fuser 108, and the reading by photosensor 200.

As shown in FIG. 2, a sheet S that is printed for purposes of calibration bears an image created by the print engine 100, the image including a portion of machine-readable trigger code indicated as C, placed on sheet S to be viewable by photosensor 200 as the sheet S moves therepast. Immediately adjacent the machine readable code C is what is here a white space (with no marking material), but what can be broadly considered a control or "white balance" area for establishing a control reflection from the light source associated with the photosensor 200. Following the control area, as sheet S moves past photosensor 200, a series of test patches T is then positioned sequentially past the photosensor 200 for recording according to a predetermined image-quality procedure.

Figure 3:
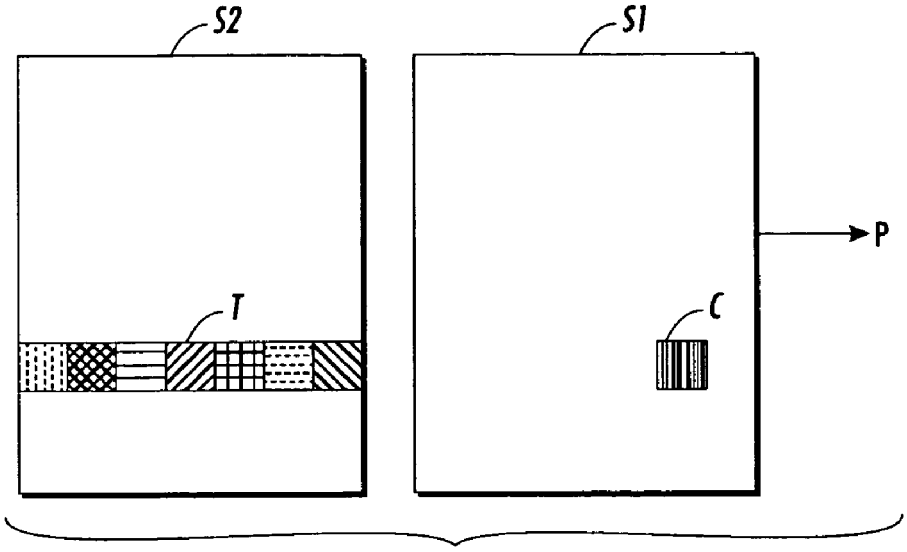
FIG. 3 is a plan view of two sheets as would emerge from the printer and move past the photosensor as in FIG. 1.

With a high-speed print engine 100, or a test routine involving a large number of necessary test patches, the test patches associated with a test routine initiated by a trigger code C may have to be spread among a plurality of sheets S. FIG. 3 is a plan view of two sheets, S1 and S2, as would emerge from the fuser 108 and move past the photosensor 200 as in FIG. 1. The first sheet to emerge from the print engine 100, indicated as S1, includes the machine-readable code and a predetermined length of control area; the second sheet S2 includes the test patches T. In various embodiments, the length along the process direction P of the control area of each test patch will be determined by the overall process speed of sheets emerging from the print engine 100, as well as the responsivity of the control systems associated with photosensor 200 (each of which affects a "dwell time" each patch must remain under the photosensor 200).

A control system such as 300 is programmed to fit test patches on whatever size sheets happen to be emerging from the machine at a given time: whereas the sheet S in FIG. 2 is on a relatively large, short-edge-fed stock, the sheets S1, S2 are on smaller, long-edge-fed stock. Since the smaller sheets cannot fit all the necessary test patches on each sheet, multiple sheets are printed. Control system 300 configures test patches on one or multiple sheets depending, for instance, on the size of the stock on which the last previous set of images was printed (such as by taking information relating to a recent print job). In this way, the printer would not have to momentarily switch, such as in the middle of a long print run, to a different input tray just to output one or two sheets for the test routine. Another parameter control system 300 takes into account is the number of individual test patches required for a particular test triggered by the immediate machine-readable code C.

The machine-readable code C must be of a configuration that is recognizable by photosensor 200 at process speeds: familiar bar-code technology can be used, but less sophisticated machine-recognizable images can be used as well. A control system can be provided that associates different machine-readable codes with performing different types of test routines, causing the photosensor 200 to "expect" different types of test patches depending on the specific machine-readable trigger code.

In one embodiment, the printing of the test sheet such as S, having the machine-readable trigger code thereon, is the primary channel for initiating image-quality test routines. In other words, in a practical application, an overall control system governing the engine 100 initiates each of various possible test routines by directly influencing the job queue or other source of image data controlling the engine 100, causing the engine to output one or more images including the desired trigger machine-readable code and related test patches. The particular test routine is initiated only when the photosensor 200 detects the trigger code, and generally not through any other channel to the control system 300.

When the photosensor 200 is used as the primary channel for initiating test routines, test routines can be scheduled through the same channels through which print jobs are scheduled, such as shown in FIG. 1 as computer 400. (In a practical application, computer 400 can be one of any number of stand-alone computers that are capable of sending print jobs to engine 100.) In one strategy, a computer acting as a source of print jobs can schedule various desired tests as print jobs, scheduling the test routines between print jobs as needed, e.g., at the beginning of a shift, or following a set of jobs adding up to a total number of prints within a predetermined range. In another strategy, for instance, a test routine is scheduled following every 10,000 prints: the counting of prints can be carried out via the print-queue software, and, in response to hitting the 10,000 count, an "interrupt job" including the test sheets is scheduled as an interrupt to whatever job is being printed at the time; but even in this case, the test routines are scheduled through the print-queue software. (Interrupt jobs are a familiar concept and utility in many types of job scheduling software.) The feedback loop controlling the engine 100 based on test patch data collected from photosensor 200 thus operates largely independently of software sending image data to the engine 100.

Figure 4:
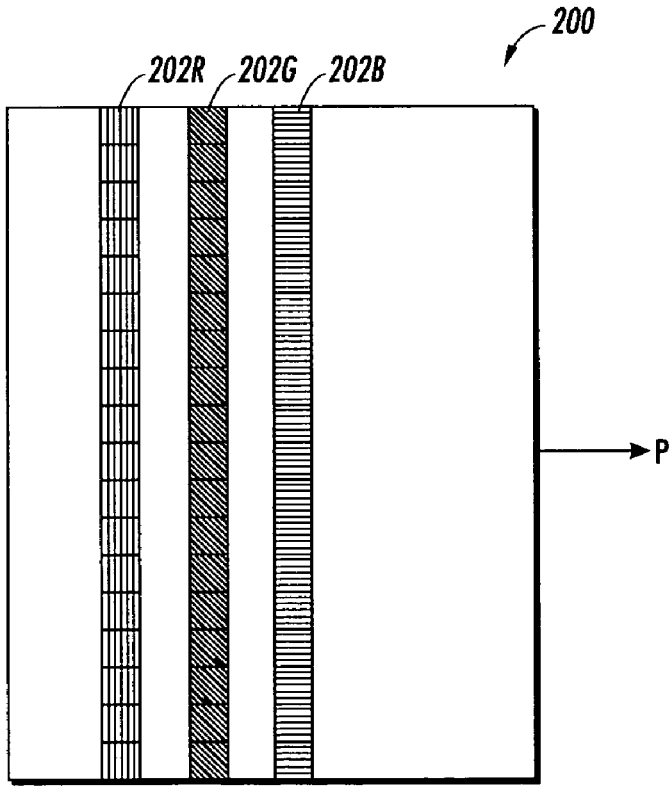
FIG. 4 is a simplified plan view of the light-sensitive portions of a photosensor.

FIG. 4 is a simplified plan view of the light-sensitive portions of a photosensor 200. In one embodiment, the photosensor is capable of distinguishing images suitable for recognizing machine-readable code such as a bar code, and also of accurately measuring reflected colors from the test patches, in effect acting as a spectrophotometer. As shown in the Figure, one embodiment of such a photosensor includes three linear arrays 202R, 202G, and 202B of photosites, each linear array including one RGB primary-color filter. U.S. Pat. No. 5,148,268 (and patents referenced thereby) gives a description of a photosensitive chip suitable for such a purpose. Alternatively, a photosensor arrangement such as shown and described in FIGS. 1 and 2 of U.S. Pat. No. 6,639,669 can be used. Although the area viewed by the photosensor 200 in the Figures is relatively narrow compared to the width of sheets being printed upon, it may be desirable in some circumstances to provide a photosensor that extends the full width of the sheet path.

Although engine 100 is shown as a color xerographic printing machine, the above-described embodiment can be readily adapted for any kind of printing technology, such as monochrome xerography, or ink-jet or offset printing. The described system can be embodied in hardware, software, or a combination thereof.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. A method of operating a digital printer, the printer including a photosensor disposed in a substantially fixed location, comprising:

deciding whether to print a machine readable code on a first sheet and at least one test patch on a second sheet, or to print the machine readable code and the at least one test patch on a one sheet;

moving the sheet having the machine readable code at a substantially constant velocity past the photosensor following printing; and in response to the photosensor detecting the machine readable code, initiating the photosensor reading the test patch.

2. The method of claim 1, wherein the photosensor is used for detecting the machine-readable code and acts a spectrophotometer for the test patch.

3. The method of claim 1, further comprising:

deciding whether to print the machine readable code on a first sheet and the at least one test patch on a second sheet, based at least partially on a sheet size of previously printed sheets.

4. The method of claim 1, further comprising:

deciding whether to print the machine readable code on a first sheet and the at least one test patch on a second sheet, based at least partially on a type of test routine triggered by detecting the machine-readable code.

5. The method of claim 1, further comprising:

initiating a test routine by causing the printer to print the machine readable code.

6. The method of claim 5, the initiating being scheduled through a channel used for scheduling print jobs.

7. The method of claim 6, the initiating being scheduled as an interrupt job.

8. The method of claim 1, further comprising:

printing the machine readable code in a manner creating a control area immediately following the machine-readable code as the sheet moves.

9. The method of claim 8, the control area preceding the at least one test patch as the sheet moves.

* * * * *